US007624606B1

(12) United States Patent
Huang et al.

(10) Patent No.: US 7,624,606 B1
(45) Date of Patent: Dec. 1, 2009

(54) REKEYABLE LOCK CYLINDER, PLUG ASSEMBLY OF THE SAME AND METHOD FOR REKEYING THE SAME

(75) Inventors: Chao-Ming Huang, Gangshan Town (TW); Chi-Ming Chen, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 22 days.

(21) Appl. No.: 12/149,757

(22) Filed: May 7, 2008

(51) Int. Cl.
*E05B 27/04* (2006.01)
*E05B 29/06* (2006.01)

(52) U.S. Cl. ..... 70/338; 70/340; 70/368; 70/383; 70/384; 70/492; 70/493; 70/495

(58) Field of Classification Search ..... 70/337–343, 70/368, 382–385, 492–496
See application file for complete search history.

(56) References Cited

U.S. PATENT DOCUMENTS 3,589,153 A * 6/1971 Hill ..... 70/384
4,376,382 A * 3/1983 Raymond et al. ..... 70/338
4,966,021 A * 10/1990 Boag ..... 70/383
6,041,631 A * 3/2000 Vonlanthen ..... 70/492
6,119,495 A * 9/2000 Loreti ..... 70/340
7,007,528 B2 * 3/2006 Chong et al. ..... 70/492
7,424,815 B1 * 9/2008 Pagnoncelli ..... 70/340
7,448,239 B1 * 11/2008 Huang et al. ..... 70/360
7,448,240 B1 * 11/2008 Huang et al. ..... 70/492
7,526,935 B2 * 5/2009 Huang et al. ..... 70/360
2003/0089149 A1 * 5/2003 Suzuki et al. ..... 70/492
2006/0101880 A1 * 5/2006 Ward-Dolkas et al. ..... 70/492
2008/0264127 A1 * 10/2008 Chiang et al. ..... 70/492

FOREIGN PATENT DOCUMENTS

JP 7197705 * 8/1995

* cited by examiner

*Primary Examiner*—Lloyd A Gall
(74) *Attorney, Agent, or Firm*—Muncy, Geissler, Olds & Lowe, PLLC

(57) ABSTRACT

A rekeyable lock cylinder comprises a cylinder body and a plug assembly disposed within the cylinder body. The plug assembly comprises a plug body, a plurality of pin assemblies and a guide bar. The plug body has a longitudinal axis, a transverse axis perpendicular to the longitudinal axis and a tool-receiving hole. Each of the pin assemblies is movably disposed in the plug body and comprises a first rack component and a second rack component selectively engaging with the first rack component. The guide bar is coupled to the plug body and has a plurality of pin runners for engaging with the first rack components and a tool-receiving portion exposed by the tool-receiving hole. The guide bar is capable of moving along transverse axis-direction of the plug body to disengage the first rack components from the second rack components.

9 Claims, 14 Drawing Sheets

REKEYABLE LOCK CYLINDER, PLUG ASSEMBLY OF THE SAME AND METHOD FOR REKEYING THE SAME

FIELD OF THE INVENTION

The present invention is generally relating to a lock cylinder, more particularly to a rekeyable lock cylinder and rekeying method thereof.

BACKGROUND OF THE INVENTION

Lock cylinder of known lock device typically is matched with a proper key so lock cylinder as well as key must be replaced in pair while replacing a lock, which results in high lock-replacing cost and inconvenience in use.

SUMMARY

The primary object of the present invention is to provide a rekeyable lock cylinder and rekeying method thereof. First, a first matched key is inserted into a plug body and then turned to drive the plug body and a guide bar turning. Next, a rekeying tool is inserted into a tool-receiving hole of the plug body to push a tool-receiving portion of the guide bar and enable a plurality of first rack components to move along transverse axis-direction of the plug body for disengaging from a plurality of second rack components. Then, the first matched key is pulled out before inserting a second matched key into the plug body. Finally, the rekeying tool is pulled out to make the first rack components reengage with the second rack components. Accordingly, the present invention may provide advantages of widely lowering re-keying cost and enhancing convenience in use, because lock replacement can be completed as soon as re-keying another matched key only without replacing lock cylinder.

A rekeyable lock cylinder in accordance with the present invention comprises a cylinder body and a plug assembly disposed within the cylinder body. The plug assembly comprises a plug body, a plurality of pin assemblies and a guide bar, wherein the plug body has a longitudinal axis, a transverse axis perpendicular to the longitudinal axis and a tool-receiving hole, each of the pin assemblies is movably disposed in the plug body and comprises a first rack component and a second rack component selectively engaging with the first rack component, and the guide bar coupled to the plug body has a plurality of pin runners servicing for engaging with the first rack components and a tool-receiving portion exposed by the tool-receiving hole. The tool-receiving portion has a tool-contacting surface facing the first rack components and the guide bar is configured to move the first rack components transversely to the longitudinal axis of the plug body to disengage the first rack components from the second rack components.

Rekeying method of a rekeyable lock cylinder in accordance with the present invention comprises initially providing a rekeyable lock cylinder, which comprises a plug body, a guide bar disposed at the plug body and a plurality of pin assemblies. The plug body has a transverse axis and a tool-receiving hole. Each of the pin assemblies comprises a first rack component and a second rack component in engagement with the first rack component. The guide bar has a tool-contacting surface facing the first rack components. Next, a first matched key is inserted into the plug body and then turned to drive the plug body and the guide bar turning. Then a rekeying tool is inserted into the tool-receiving hole to push the tool-contacting surface of the guide bar, which enables the first rack components to move along transverse axis-direction of the plug body to disengage from the second rack components. Next, a second matched key is inserted into the plug body after pulling out the first matched key. Finally, the rekeying tool is pulled out to make the first rack components reengage with the second rack components.

DETAILED DESCRIPTION OF THE INVENTION

Figure 1:
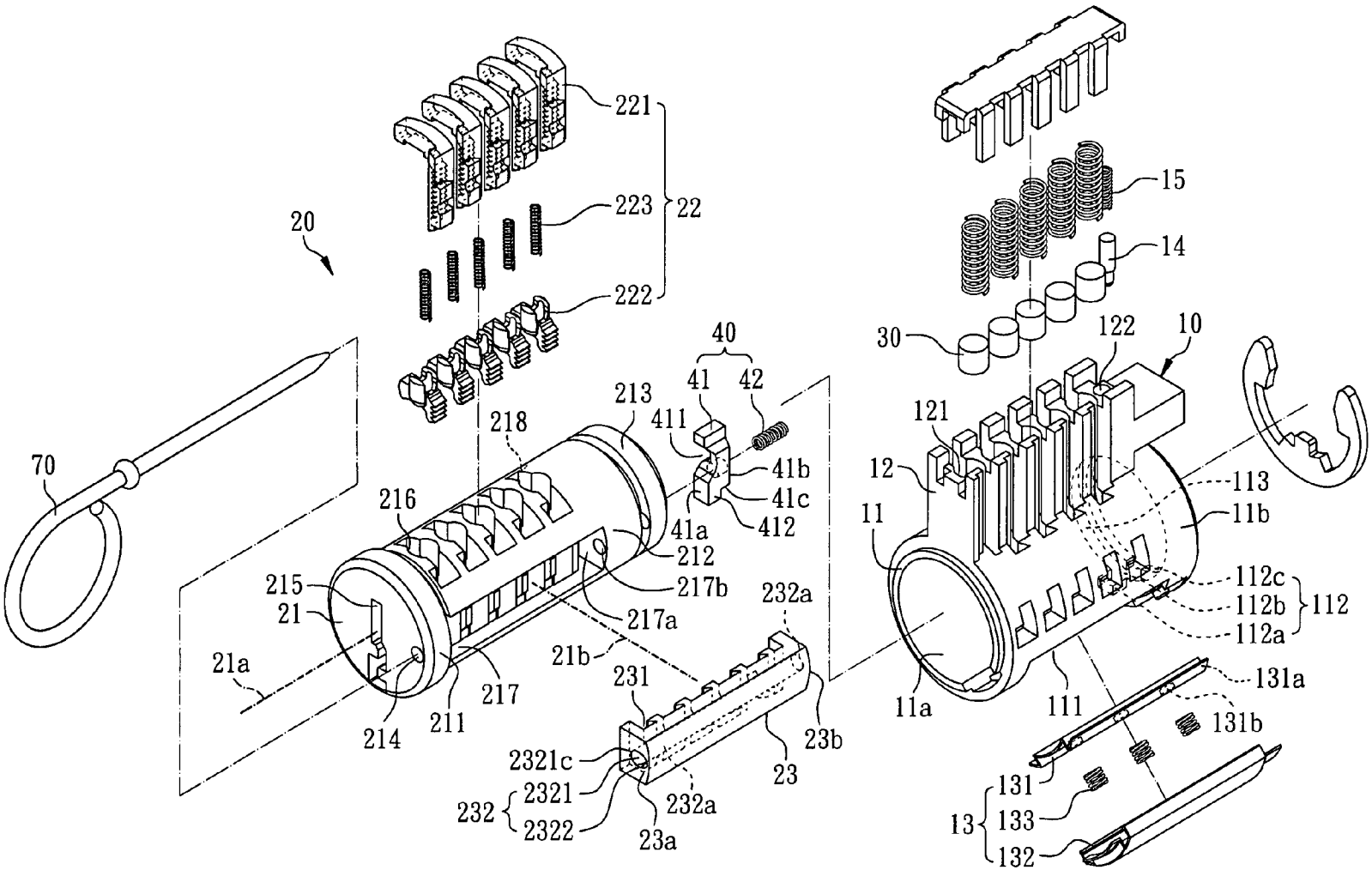
FIG. 1 is an exploded perspective view illustrating a rekeyable lock cylinder in accordance with a preferred embodiment of the present invention.
Figure 2:
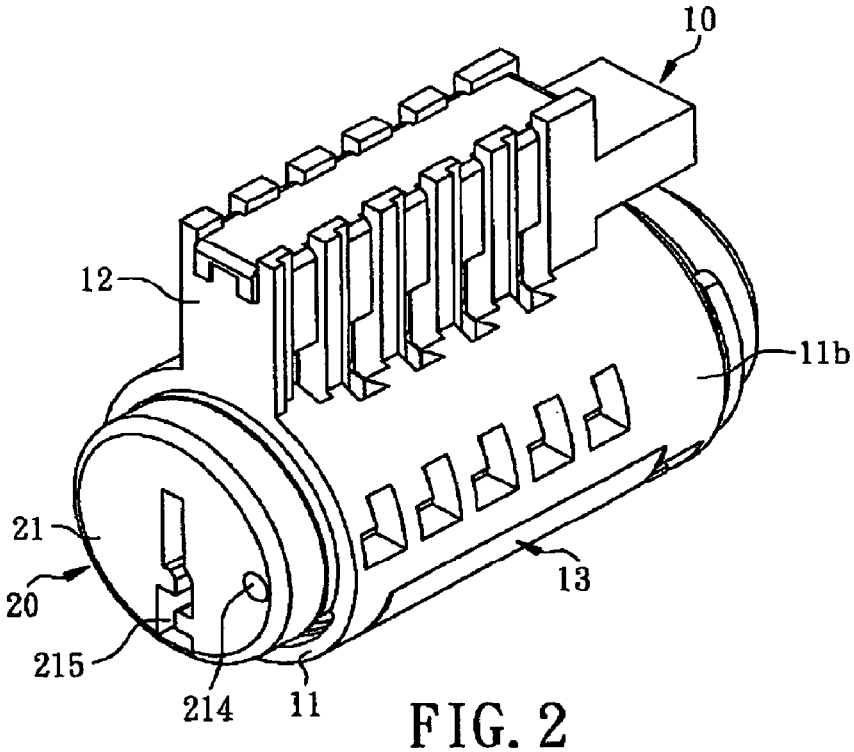
FIG. 2 is an assembled perspective view illustrating the rekeyable lock cylinder.
Figure 3A:
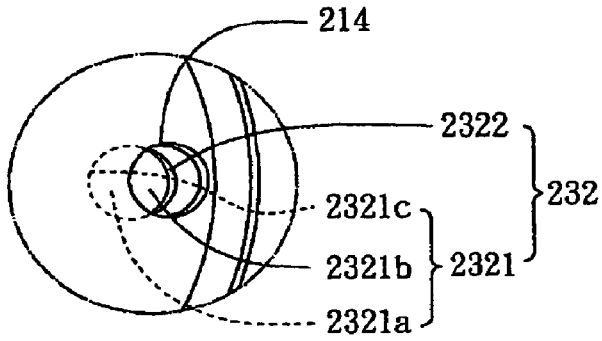
FIG. 3*a* is an enlarge view of the rekeyable lock cylinder of FIG. 3 taken from the encircled dotted line portion of FIG. 3.
Figure 3:
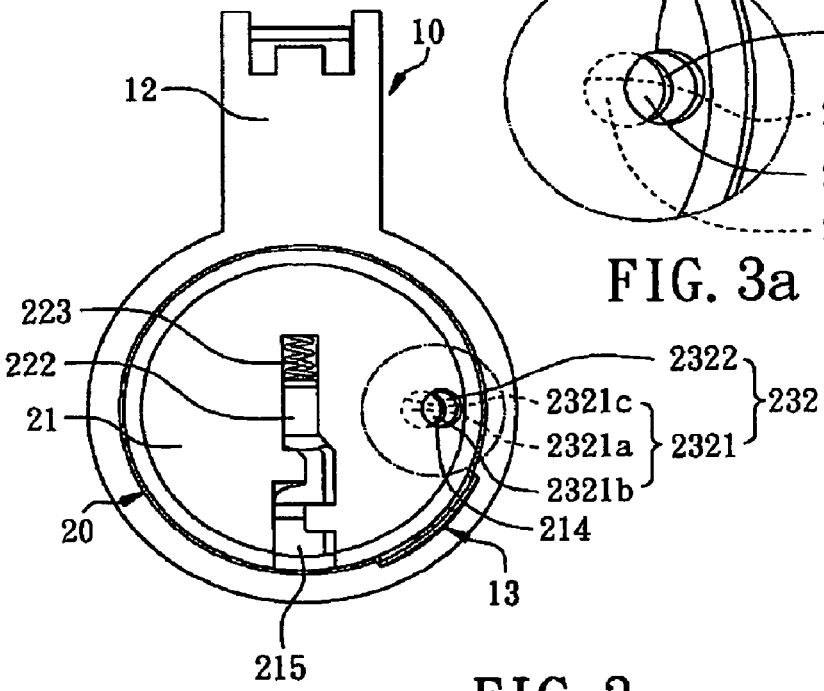
Figure 4:
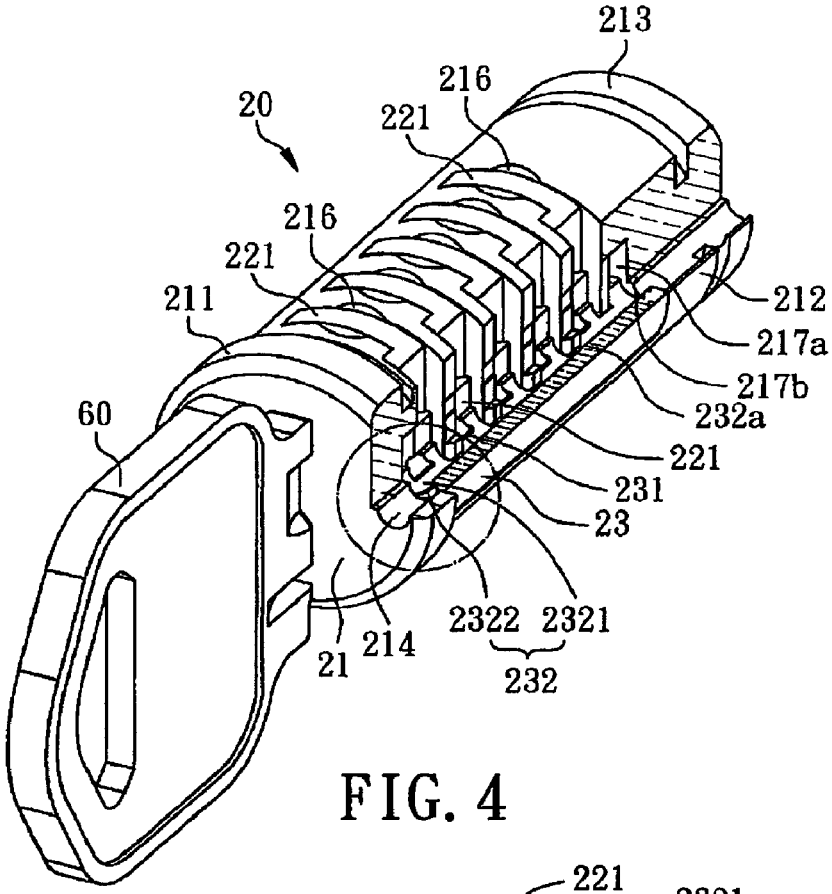
FIG. 4 is an assembled perspective view illustrating a plug assembly in accordance with a preferred embodiment of the present invention.
Figure 4A:
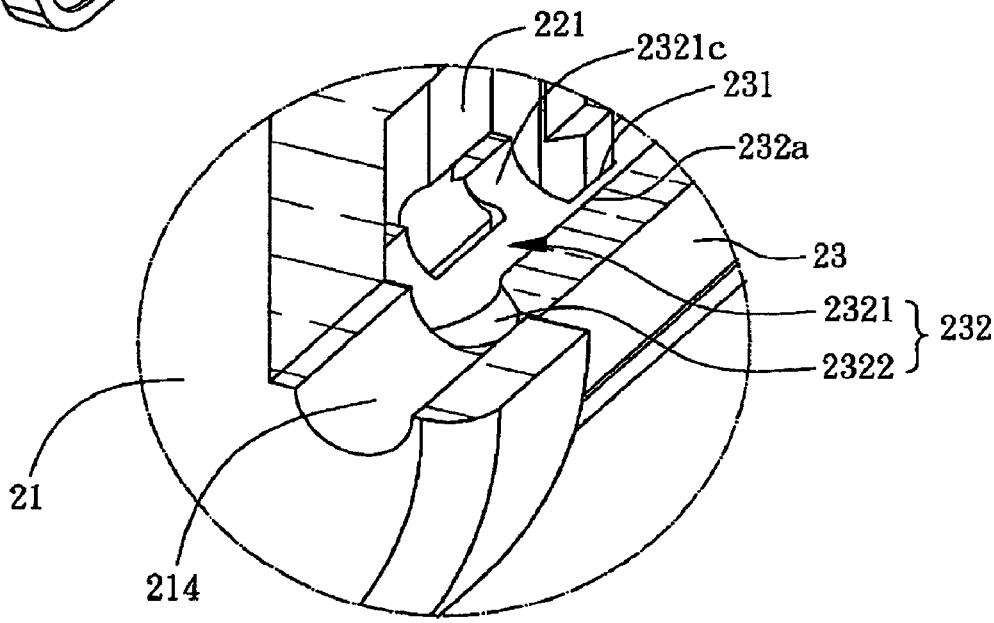
FIG. 4*a* is an enlarged view of the plus assembly of FIG. 4 taken from the encircled dotted line portion of FIG. 4.

FIGS. 1 and 2 illustrates a rekeyable lock cylinder in accordance with a preferred embodiment of the present invention comprising a cylinder body 10, a plug assembly 20 disposed within the cylinder body 10 and a plurality of upper pins 30. The cylinder body 10 comprises a hollow cylinder portion 11 for accommodating the plug assembly 20, an extending protrusion 12 formed at one side of the hollow cylinder portion 11, a resilient assembly 13 disposed at the hollow cylinder portion 11, a location bar 14 and a first spring 15 serving for pushing the location bar 14. Or, the cylinder body 10 may omit manufacturing the extending protrusion 12 in another embodiment. In this embodiment, the hollow cylinder portion 11 has an inside wall 11*a*, an outside wall 11*b*, a recession 111, an axial groove 112 and a radial groove 113, wherein the recession 111, the axial groove 112 and the radial groove 113 are recessed from the inside wall 11*a*. Preferably, the recession 111 communicates with the inside wall 11*a* and the outside wall 11*b*. The axial groove 112 in communication with the radial groove 113 comprises a first limiting area 112*a*, an overlapping area 112*b* and a second limiting area 112*c*, wherein the overlapping area 112*b* is where the axial groove 112 communicates with and intersects the radial groove 113, the first limiting area 112*a* and the second limiting area 112*c* are respectively located at the two sides of the overlapping area 112*b*. The extending protrusion 12 has a plurality of upper pin holes 121 and a straight slot 122 parallel to the upper pin holes 121, the upper pin holes 121 and the straight slot 122 communicate with the hollow cylinder portion 11. Referring to FIGS. 1, 2 and 4, the resilient assembly 13 disposed at the recession 111 of the hollow cylinder portion 11 has a movable plate 131, an immovable plate 132 affixed at the recession 111 and at least one resilient member 133 disposed between the movable plate 131 and the immovable plate 132. In this embodiment, the movable plate 131 is transversely movable within the recession 111 and has a surface 131*a* facing the resilient member 133 and at least one pillar 131*b* projecting from the surface 131*a*, and preferably the resilient member 133 is disposed on the pillar 131*b* of the movable plate 131 and two ends of the resilient member 133 contact against the movable plate 131 and the immovable plate 132 respectively. In addition, the location bar 14 and the first spring 15 are disposed within the straight slot 122 of the extending protrusion 12 in this embodiment.

Figure 6:
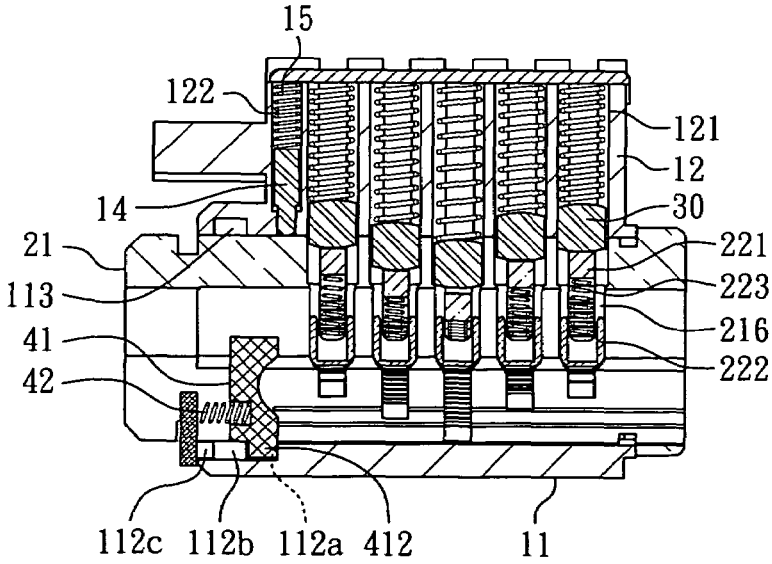
FIG. 6 is a transverse section view illustrating the rekeyable lock cylinder along A-A line of FIG. 5.

Referring to FIGS. 1 and 4, the plug assembly 20 comprises a plug body 21, a plurality of pin assemblies 22 and a guide bar 23 coupled to the plug body 21. The plug body 21 has a longitudinal axis 21*a*, a transverse axis 21*b* perpendicular to the longitudinal axis 21*a*, a front portion 211, a middle portion 212, a drive portion 213, a tool-receiving hole 214 penetrating the front portion 211 and a keyhole 215. In this embodiment, the middle portion 212 has a plurality of pin holes 216 serving for disposing the pin assemblies 22, a trench 217 communicating with the pin holes 216 and a catching slot 218, wherein the trench 217 has a trench wall 217*a* facing the tool-receiving hole 214 and a tool-fixing hole 217*b* recessing from the trench wall 217*a*, and preferably the tool-fixing hole 217*b* corresponds to the tool-receiving hole 214. Besides, the tool-receiving hole 214 communicates with the trench 217. Referring to FIGS. 1, 4 and 6, the pin assemblies 22 are movably disposed within the pin holes 216 of the plug body 21. In this embodiment, the pin assemblies 22 are height-adjustable pins and each of the pin assemblies 22 comprises a first rack component 221 engaged with the guide bar 23, a second rack component 222 selectively engaging with the first rack component 221 and an elastic component 223 disposed between the first rack component 221 and the second rack component 222. Referring to FIGS. 1, 3, 4, 22, 23 and 24, the guide bar 23 disposed at the trench 217 of the middle portion 212 of the plug body 21 has a first side 23*a* facing the tool-receiving hole 214, a second side 23*b* facing the drive portion 213, a plurality of pin runners 231 serving for engaging with the first rack components 221 and a tool-receiving portion 232 exposed by the tool-receiving hole 214, wherein the tool-receiving portion 232 has a groove 2321 recessed from the first side 23*a* and used for receiving a rekeying tool, a chute 2322 recessed from the first side 23*a* and used for guiding the rekeying tool and a tool-contacting surface 232*a* located within the groove 2321, preferably the groove 2321 is in communication with the first side 23*a* and the second side 23*b*. The groove 2321 has a first groove portion 2321*a* (left portion of the groove 2321), a second groove portion 2321*b* (right portion of the groove 2321) corresponding to the tool-receiving hole 214 and an inner wall 2321*c*. The chute 2322 communicates with the groove 2321 and the tool-contacting surface 232*a* faces the first rack components 221, and preferably the tool-contacting surface 232*a* is part of the inner wall 2321*c*. Referring again to FIGS. 1 and 6, the upper pins 30 are configured and disposed to move in the upper pin holes 121 of the extending protrusion 12 of the cylinder body 10 and the pin holes 216 of the middle portion 212 of the plug body 21.

Moreover, referring again to FIGS. 1 and 6, the present invention further comprises a limit assembly 40 disposed at the plug body 21 as to enhance burglar-proofness and security. The limit assembly 40 has a limiting block 41 and a second spring 42 contacting against the limiting block 41. The limiting block 41, disposed at the keyhole 215 of the plug body 21 and adjacent to the drive portion 213, projects from the plug body 21 and corresponds to the axial groove 112 of the hollow cylinder portion 11. In this embodiment, the limiting block 41 can move within the axial groove 112 of the hollow cylinder portion 11 and has a first lateral 41*a*, a chamfer 411 recessed from the first lateral 41*a* and corresponding to the keyhole 215, a second lateral 41*b* opposite to the first lateral 41*a*, a bottom surface 41*c* facing the axial groove 112 and a protrusion 412 projecting from the bottom surface 41*c*. The protrusion 412, also projecting from the plug body 21, is disposed to move within the axial groove 112 of the hollow cylinder portion 11 capable of limiting the plug body 21 not to be turned around. Referring again to FIGS. 1 and 6, the second spring 42 is disposed between the drive portion 213 of the plug body 21 and the limiting block 41 and one end of the second spring 42 contacts against the second lateral 41*b* of the limiting block 41. In this embodiment, if an unmatched key (not shown in the drawings) is inserted into the keyhole 215 of the plug body 21 with opportune beat and turn for unlocking in a locked condition, it merely makes that the protrusion 412 of the limiting block 41 moves from the first limiting area 112*a* of the axial groove 112 to the second limiting area 112*c*. Meantime, despite the upper pins 30 or the pin assemblies 22 cannot limit the plug body 21 not to be turned around, but the protrusion 412 still can limit the plug body 21 not to be turned around. The present invention also utilizes the limiting block 41 and the second spring 42 to strength lock cylinder structure and increases unlocking difficulty for an unmatched key, thereby widely enhancing burglar-proofness and security of the lock cylinder structure.

Figure 5:
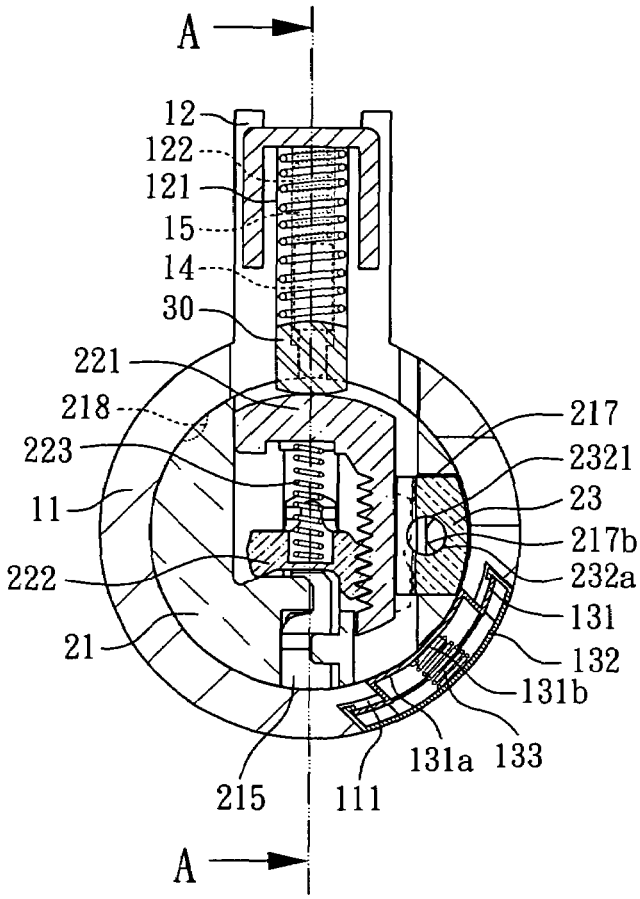
FIG. 5 is an assembled longitudinal section view illustrating the rekeyable lock cylinder.
Figure 7:
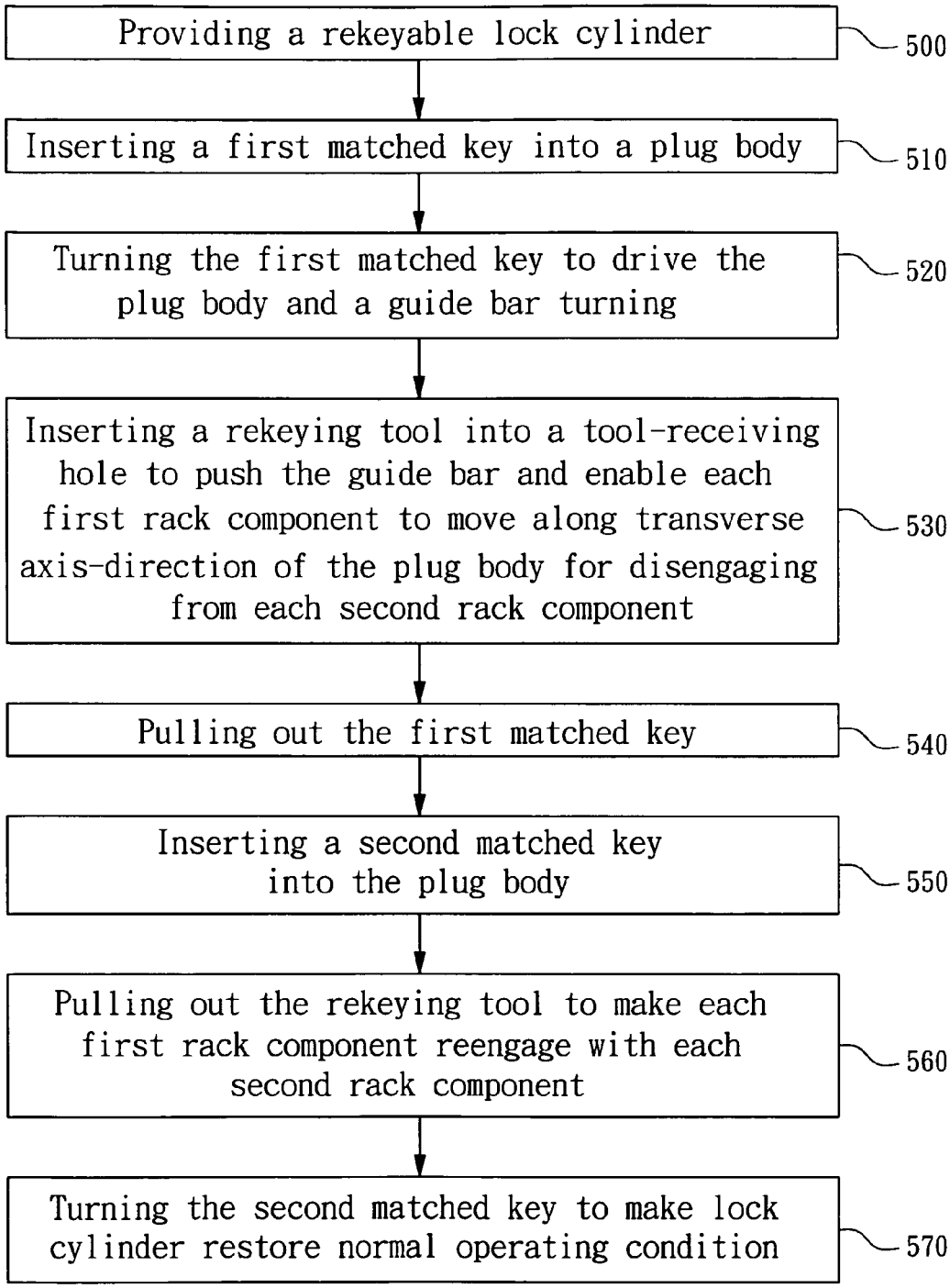
FIG. 7 is a flow chart for rekeying method of the rekeyable lock cylinder.
Figure 8:
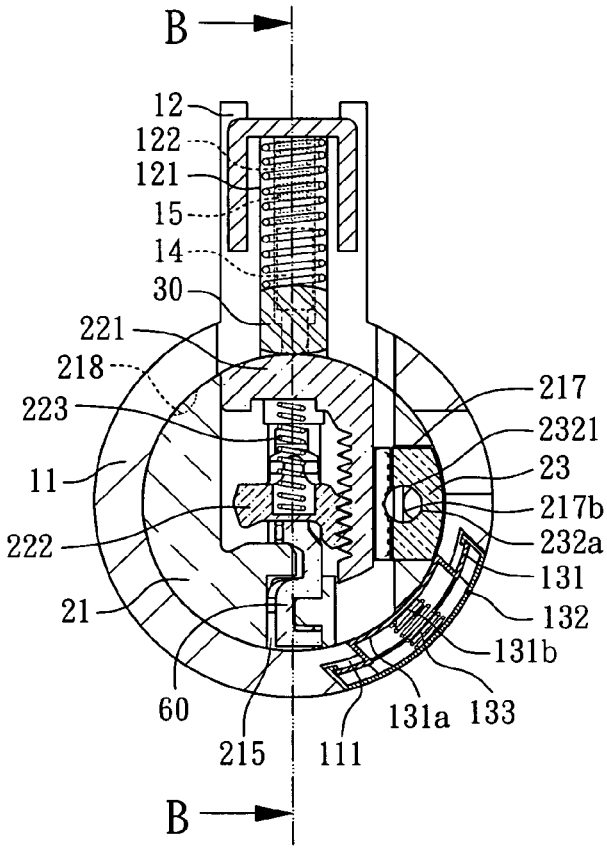
FIG. 8 is a longitudinal section view illustrating the first matched key is inserted into the rekeyable lock cylinder in accordance with a preferred embodiment of the present invention.
Figure 9:
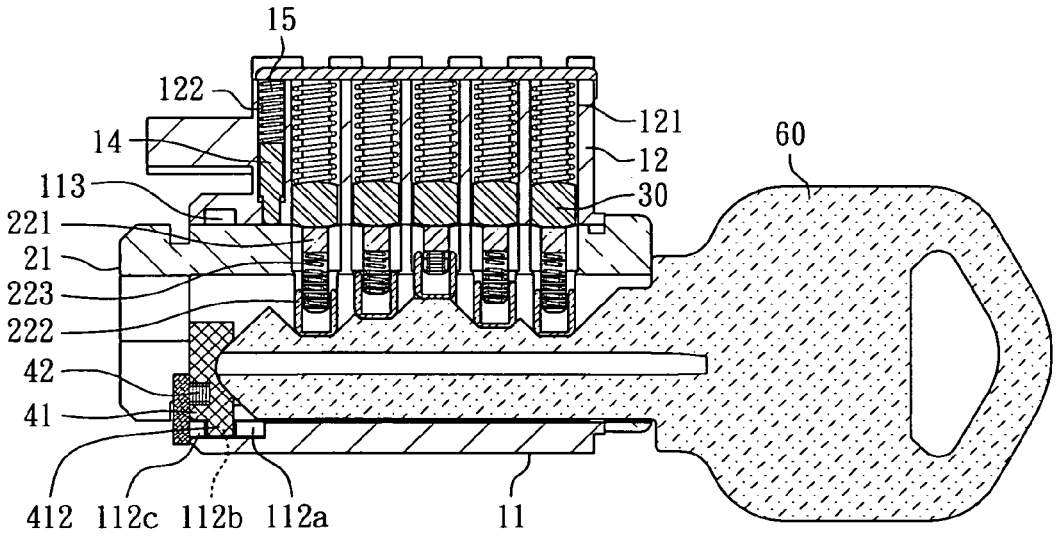
FIG. 9 is a transverse section view illustrating the first matched key is inserted into the rekeyable lock cylinder along B-B line of FIG. 8.
Figure 10:
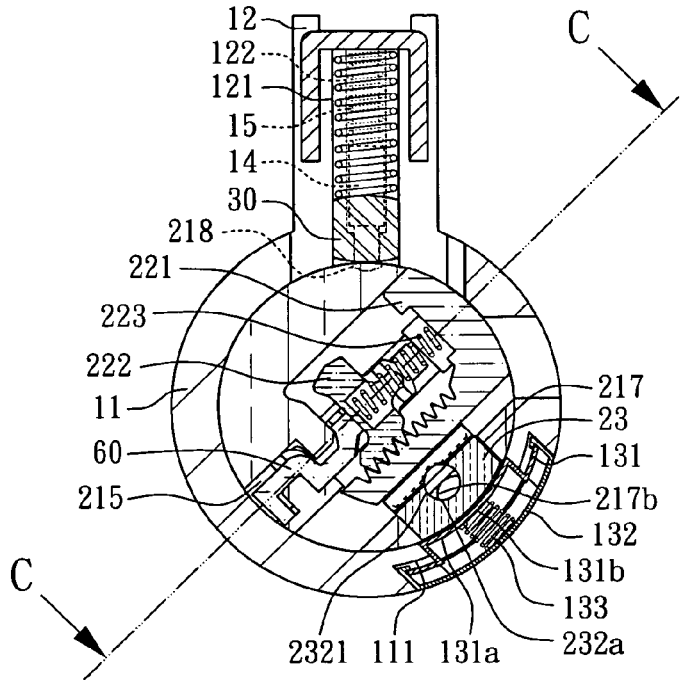
FIG. 10 is a longitudinal section view illustrating the first matched key is turned 45-degrees clockwise in accordance with a preferred embodiment of the present invention.
Figure 11:
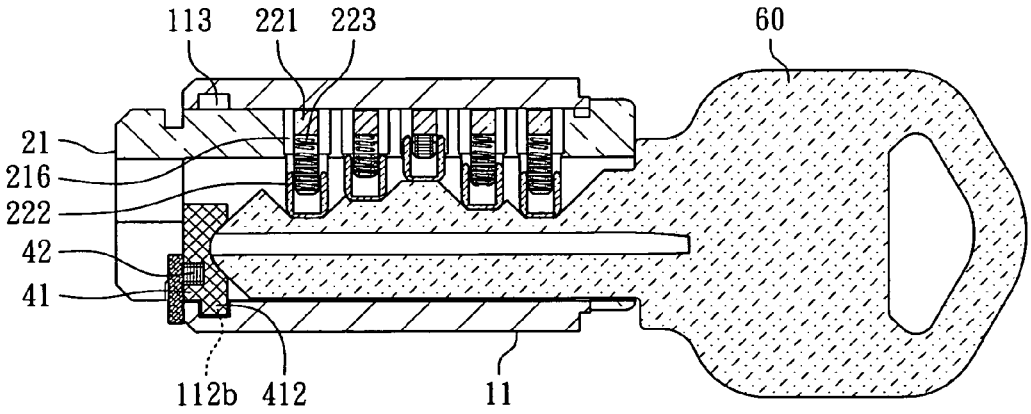
FIG. 11 is a transverse section view illustrating the first matched key is turned 45-degrees clockwise along C-C line of FIG. 10.
Figure 12:
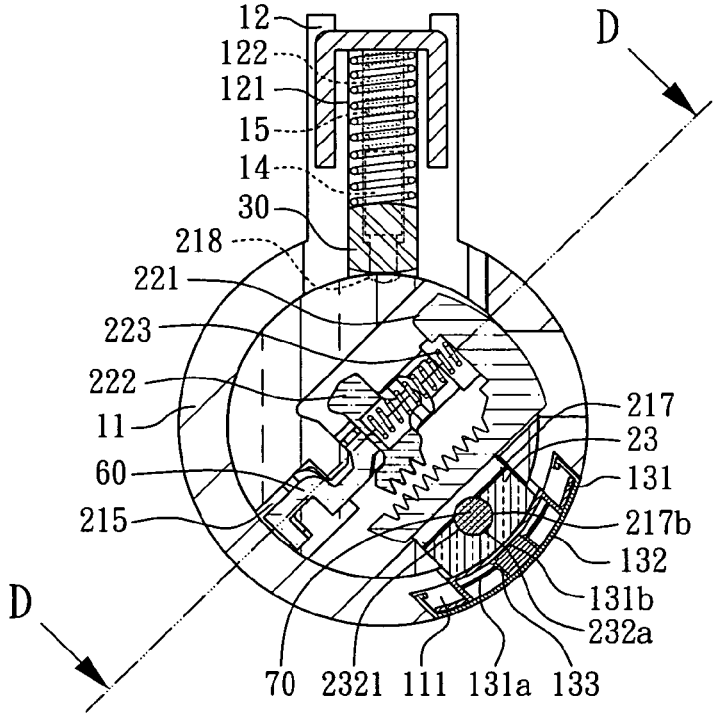
FIG. 12 is a longitudinal section view illustrating the rekeying tool is inserted into the rekeyable lock cylinder in accordance with a preferred embodiment of the present invention.
Figure 13:
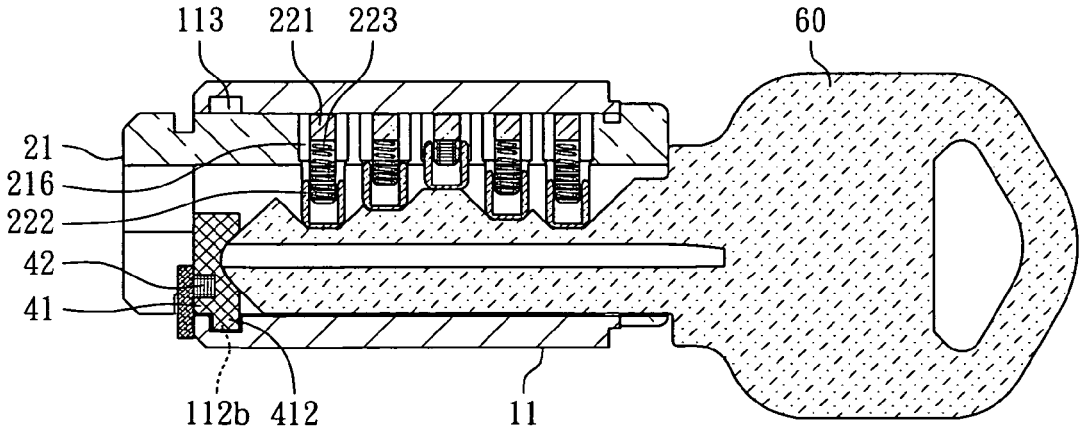
FIG. 13 is a transverse section view illustrating the rekeying tool is inserted into the rekeyable lock cylinder along D-D line of FIG. 12.
Figure 14:
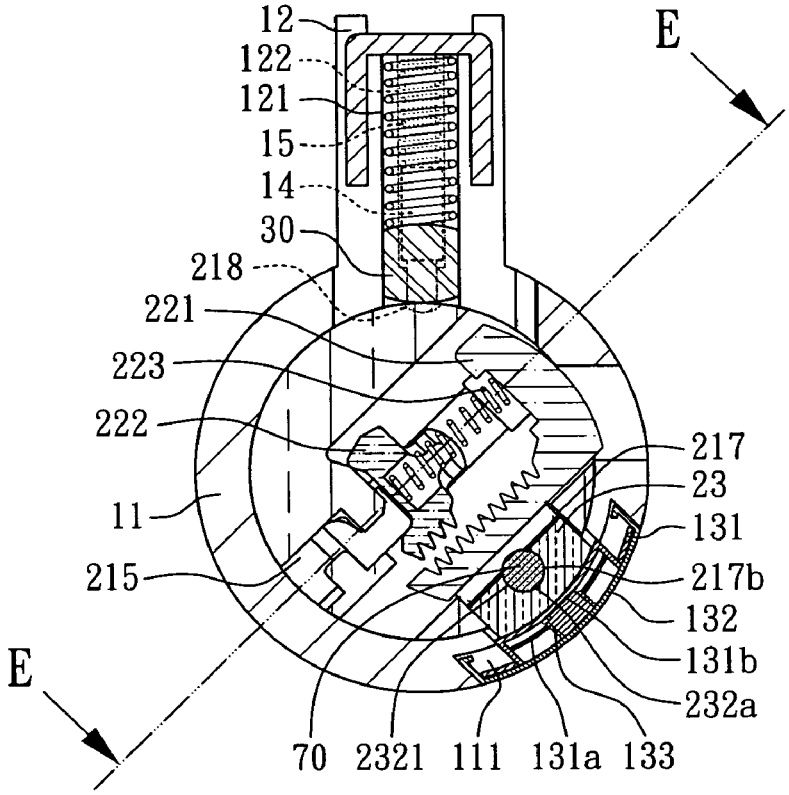
FIG. 14 is a longitudinal section view illustrating the first matched key is pulled out in accordance with a preferred embodiment of the present invention.
Figure 15:
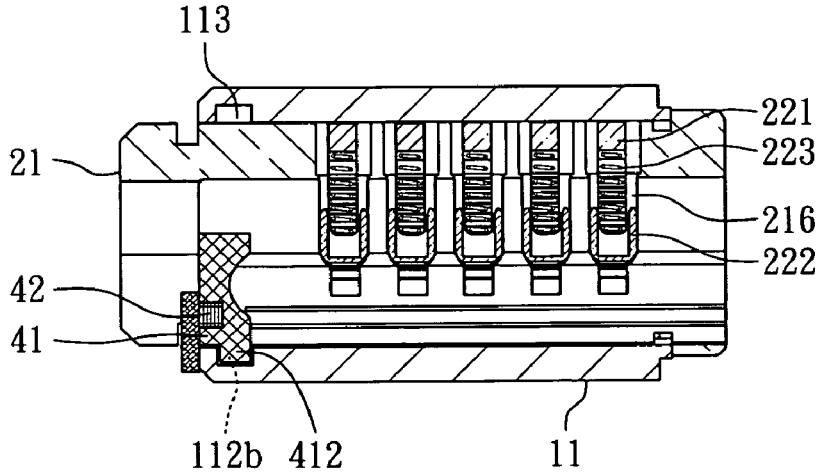
FIG. 15 is a transverse section view illustrating the first matched key is pulled out along E-E line of FIG. 14.
Figure 16:
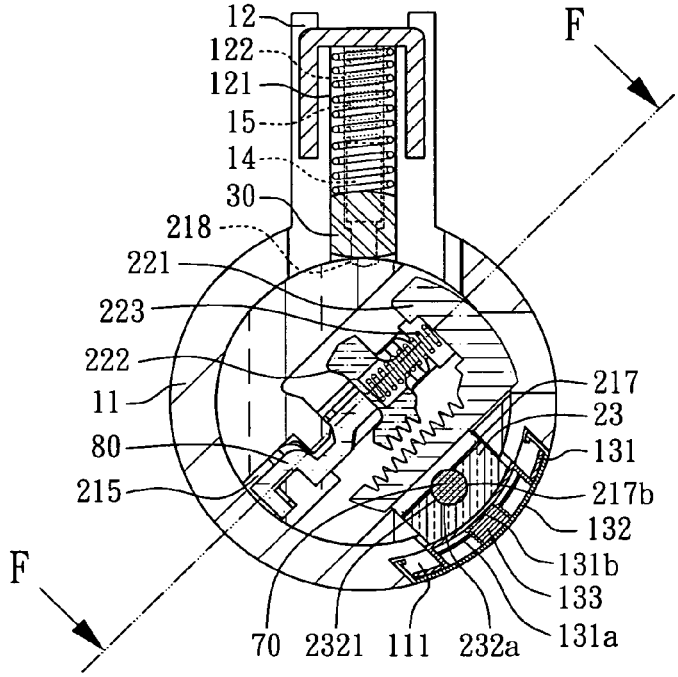
FIG. 16 is a longitudinal section view illustrating the second matched key is inserted into the rekeyable lock cylinder in accordance with a preferred embodiment of the present invention.
Figure 17:
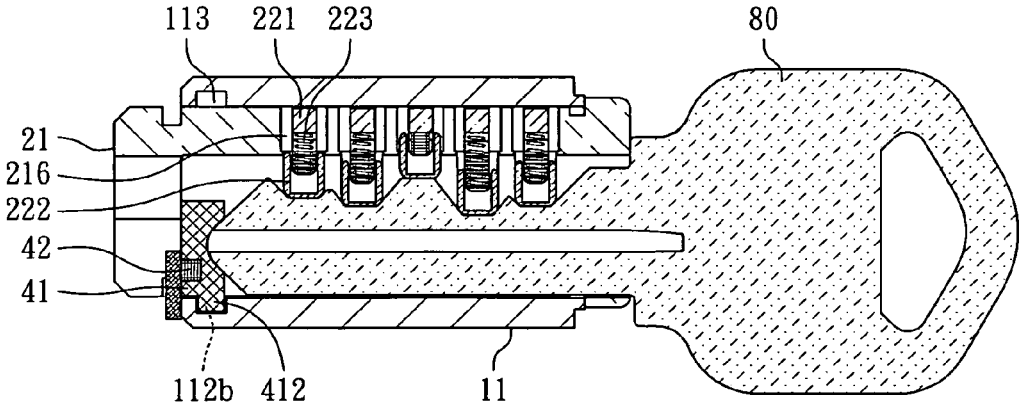
FIG. 17 is a transverse section view illustrating the second matched key is inserted into the rekeyable lock cylinder along F-F line of FIG. 16.
Figure 18:
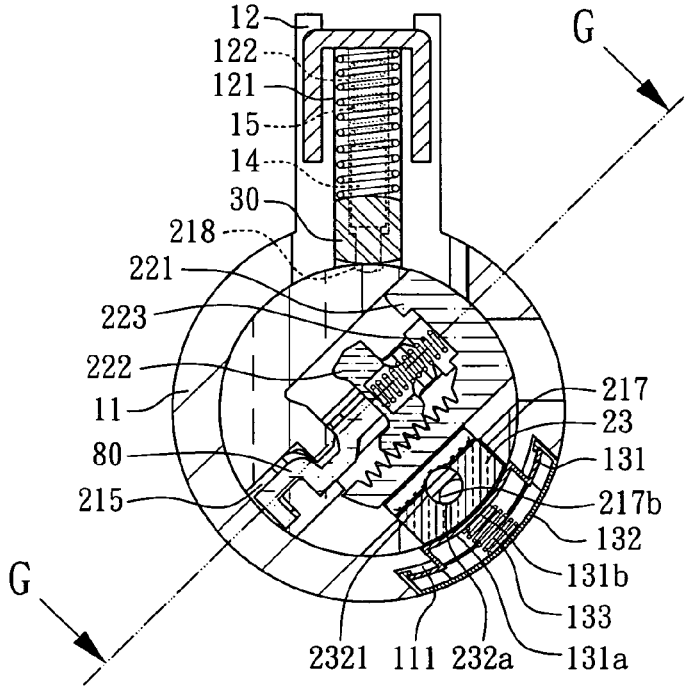
FIG. 18 is a longitudinal section view illustrating the rekeying tool is pulled out in accordance with a preferred embodiment of the present invention.
Figure 19:
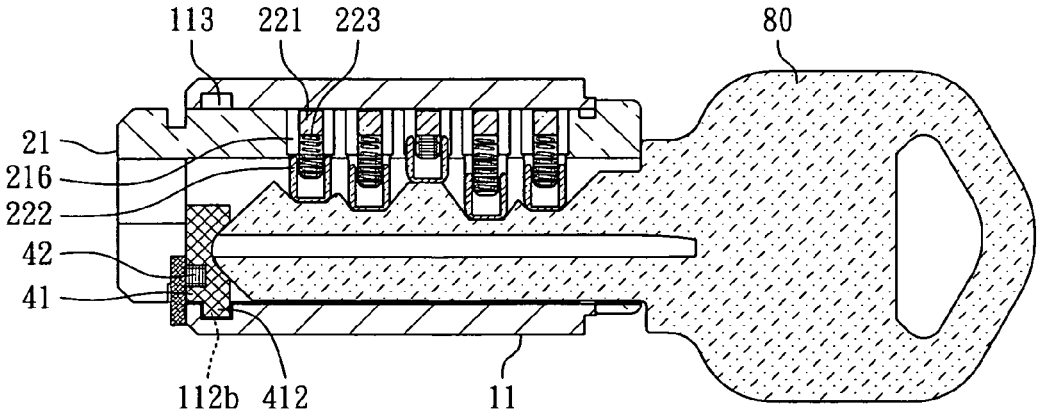
FIG. 19 is a transverse section view illustrating the rekeying tool is pulled out along G-G line of FIG. 18.
Figure 20:
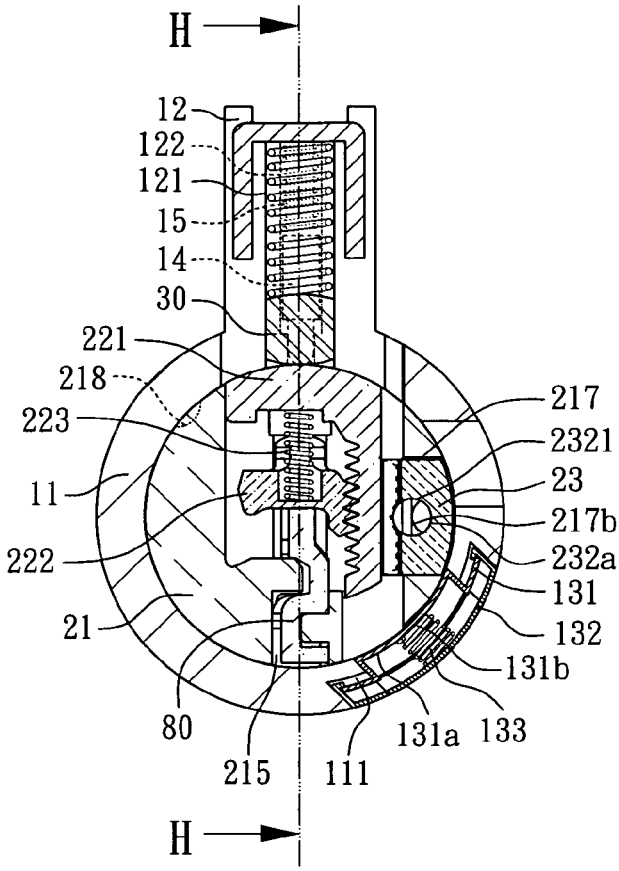
FIG. 20 is a longitudinal section view illustrating the rekeyable lock cylinder in normal service condition in accordance with a preferred embodiment of the present invention.
Figure 21:
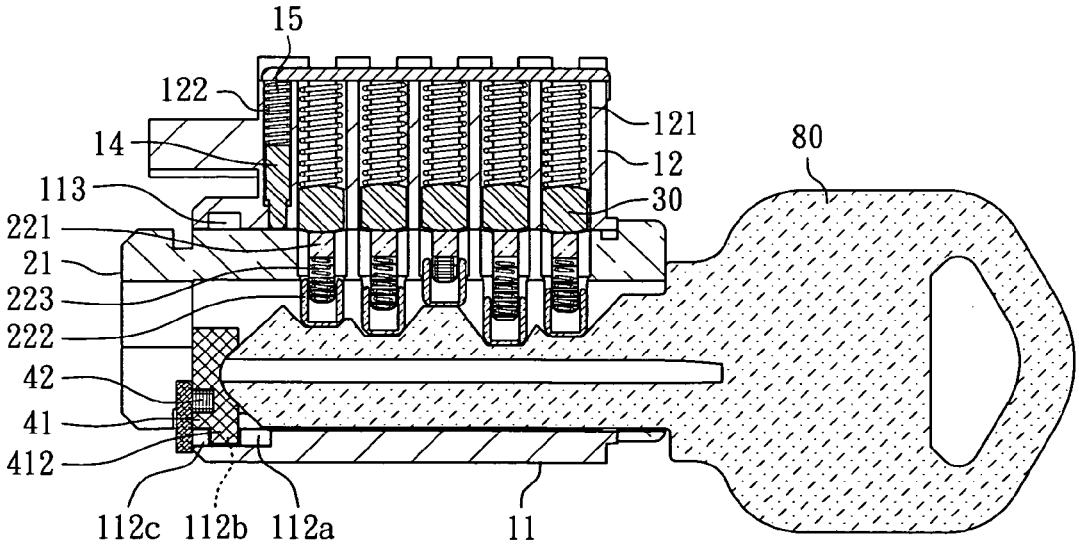
FIG. 21 is a transverse section view illustrating the rekeyable lock cylinder in normal service condition along H-H line of FIG. 20.
Figure 22:
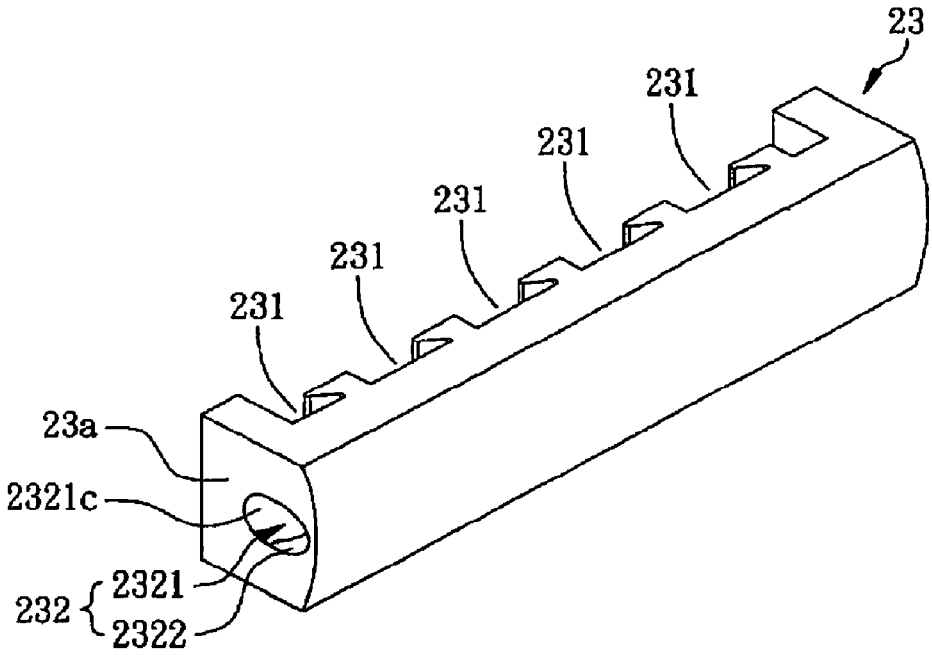
FIG. 22 is an enlarged view of the guide bar.
Figure 23:
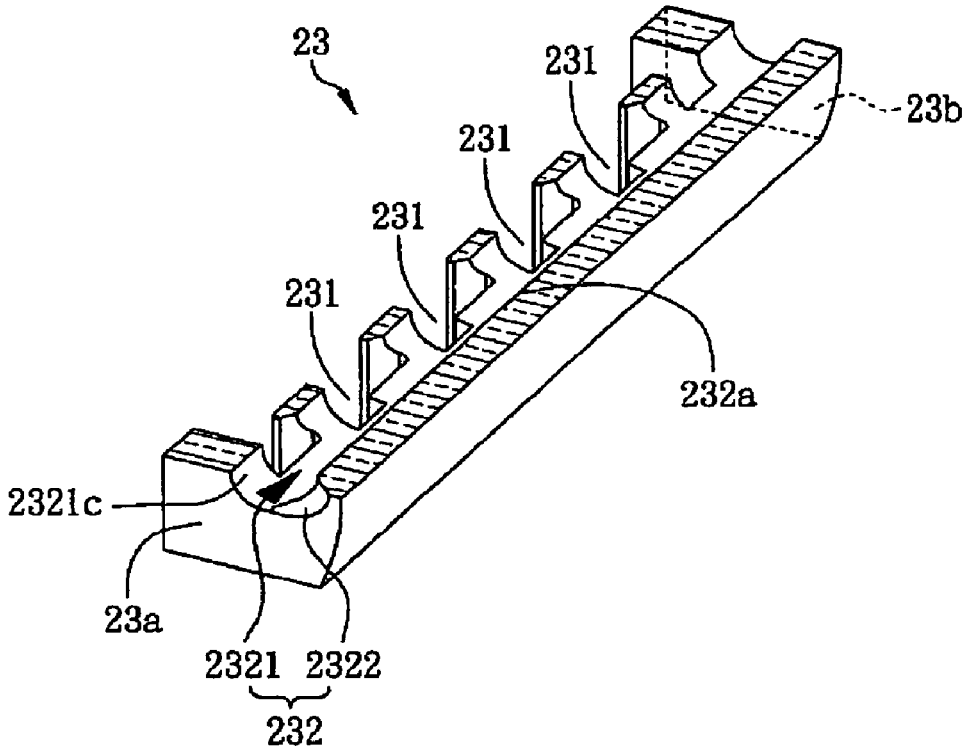
FIG. 23 is a cross-section view of the guide bar.
Figure 24:
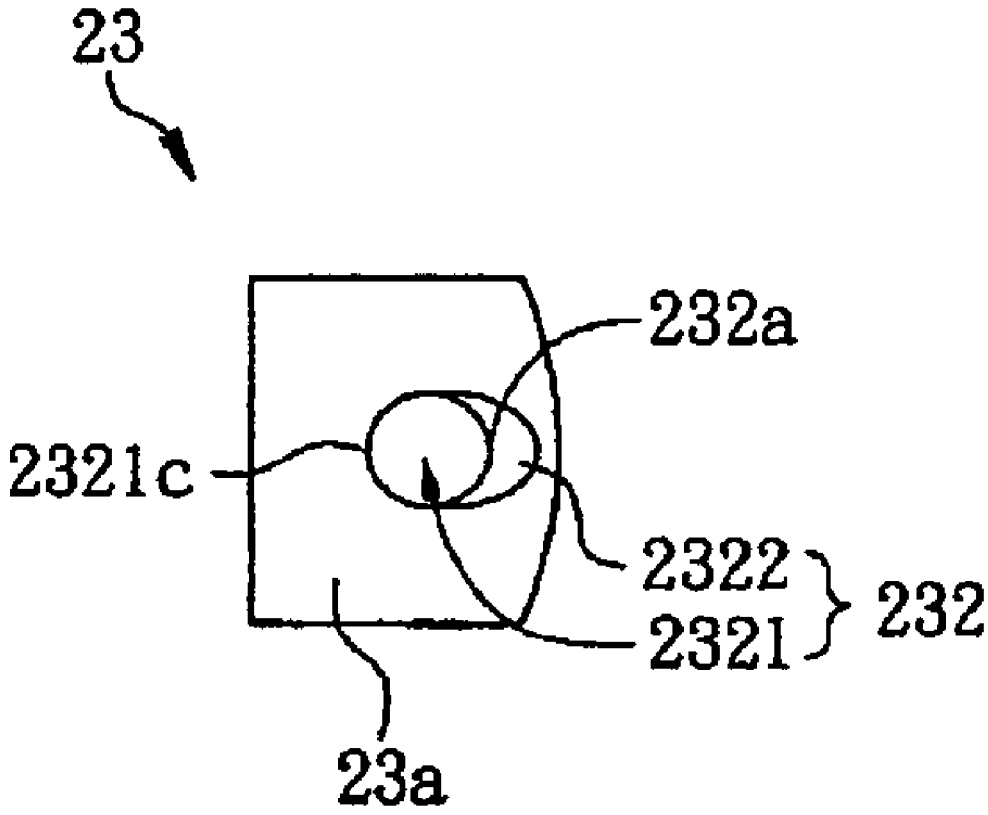
FIG. 24 is a side view of the guide bar.

FIG. 7 illustrates rekeying method of the rekeyable lock cylinder comprising "providing a rekeyable lock cylinder" step 500, "inserting a first matched key into a plug body" step 510, "turning the first matched key to drive the plug body and a guide bar turning" step 520, "inserting a rekeying tool into a tool-receiving hole to push the guide bar and enable each first rack component to move along transverse axis-direction of the plug body for disengaging from each second rack component" step 530, "pulling out the first matched key" step 540, "inserting a second matched key into the plug body" step 550, "pulling out the rekeying tool to make each first rack component reengage with each second rack component" step 560 and "turning the second matched key to make lock cylinder restore normal operating condition" step 570. Initially, referring to FIGS. 2, 5 and 6, "providing a rekeyable lock cylinder" step 500 is performed, in which the rekeyable lock cylinder is composed by assembling the cylinder body 10, the plug assembly 20 and the upper pins 30. In this embodiment, the tool-receiving hole 214 corresponds to the second groove portion 2321*b* of the groove 2321 and there is a condition that the first rack components 221 are in engagement with the second rack components 222. Next, referring to FIGS. 7, 8 and 9, "inserting a first matched key into a plug body" step 510 is performed, in which a first matched key 60 is inserted into the keyhole 215 of the plug body 21 and pushes the pin assemblies 22 upwardly move to turning interface in this embodiment. Next, referring to FIGS. 7, 10 and 11, "turning the first matched key to drive the plug body and a guide bar turning" step 520 is performed, in which the first matched key 60 is turned to drive the plug body 21 and the guide bar 23 turning to a predetermined angular position and the first matched key 60 is turned about 45-degrees clockwise in this embodiment. Meantime, the catching slot 218 of the middle portion 212 of the plug body 21 corresponds to the location bar 14 that allows the location bar 14 be caught by the catching slot 218, and the plug body 21, the guide bar 23 and the pin assemblies 22 are limited at 45-degrees position by the location bar 14, wherein the guide bar 23 corresponds to the recession 111 of the hollow cylinder portion 11 and the resilient assembly 13 and contacts against the movable plate 131 of the resilient assembly 13. Next, referring to FIGS. 1, 3, 4, 4*a*, 7, 12 and 13, "inserting a rekeying tool into a tool-receiving hole to push a tool-receiving portion of the guide bar and enable each first rack component to move along transverse axis-direction of the plug body for disengaging from each second rack component" step 530 is performed, in which a rekeying tool 70 is inserted into the tool-receiving hole 214 of the plug body 21. Meantime, the rekeying tool 70 pushes the tool-contacting surface 232*a* of the tool-receiving portion 232 of the guide bar 23 for allowing the guide bar 23 to move to the resilient assembly 13. In this embodiment, the rekeying tool 70 first contacts against the chute 2322 of the tool-receiving portion 232 and then slides into the groove 2321 of the tool-receiving portion 232 along the chute 2322 and contacts against the tool-contacting surface 232*a*. When the rekeying tool 70 penetrates the groove 2321 of the tool-receiving portion 232, it pushes the guide bar 23 moving along transverse axis-direction of the plug body 21 and the movable plate 131 of the resilient assembly 13 is pushed by the guide bar 23 moving to the immovable plate 132 and compresses the resilient member 133. In this embodiment, a space needed for the guide bar 23 to move in can be provided by that the movable plate 131 moves away. Besides, the guide bar 23 moves to drive each of the first rack components 221 moving along transverse axis-direction of the plug body 21 capable of disengaging each of the first rack components 221 from each of the second rack components 222 and meantime the tool-receiving hole 214 corresponds to the first groove portion 2321*a* and the second groove portion 2321*b* of the groove 2321. In addition, the rekeying tool 70 is inserted into the tool-fixing hole 217*b* in this embodiment for affixing the guide bar 23 and the first rack components 221. Next, referring to FIGS. 7, 14 and 15, "pulling out the first matched key" step 540 is performed, in which the first matched key 60 is pulled out. When the first matched key 60 is pulled out in this embodiment, the second rack components 222 of the pin assemblies 22 are pushed by the elastic components 223 to fall to lowermost position. Next, referring to FIGS. 7, 16 and 17, "inserting a second matched key into the plug body" step 550 is performed, in which a second matched key 80 is inserted into the keyhole 215 of the plug body 21 and the second rack components 222 of the pin assemblies 22 in this embodiment will readjust height in accordance with different height of bitting of the second matched key 80. Next, referring to FIGS. 7, 18 and 19, "pulling out the rekeying tool to make each first rack component reengage with each second rack component" step 560 is performed, in which the rekeying tool 70 is pulled out and meantime the guide bar 23 is pushed by the resilient member 133 of the resilient assembly 13 to restore and drive the first rack components 221 to reengage with the second rack components 222. Finally, referring to FIGS. 7, 20 and 21, "turning the second matched key to make lock cylinder restore normal operating condition" step 570 is performed, in which the second matched key 80 is turned to make the rekeyable lock cylinder restore normal operating condition.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A rekeyable lock cylinder comprising:

a cylinder body; and a plug assembly disposed within the cylinder body comprising:

a plug body having a longitudinal axis;

a guide bar coupled to the plug body; and a plurality of pin assemblies movably disposed in the plug body, each of the pin assemblies comprising a first rack component engaged with the guide bar and a second rack component selectively engaging with the first rack component, wherein the guide bar is configured to move the first rack components transversely to the longitudinal axis of the plug body to disengage the first rack components from the second rack components, wherein the cylinder body comprises a resilient assembly and a hollow cylinder portion for disposing the plug assembly, the hollow cylinder portion has an inside wall and a recession recessed from the inside wall, the resilient assembly is disposed within the recession, and wherein the resilient assembly comprises a movable plate that is capable of being pushed to move by the guide bar and at least one resilient member contacting against the movable plate.

2. The rekeyable lock cylinder in accordance with claim 1, wherein the resilient assembly further comprises an immovable plate affixed at the recession of the hollow cylinder portion, the resilient member is disposed between the movable plate and the immovable plate.

3. The rekeyable lock cylinder in accordance with claim 1, wherein the plug body has a front portion, a middle portion, a drive portion and a tool-receiving hole penetrating the front portion, the middle portion has a plurality of pin holes for disposing the pin assemblies and a trench in communication with the pin holes, the guide bar is disposed within the trench and the tool-receiving hole is in communication with the trench.

4. The rekeyable lock cylinder in accordance with claim 3, wherein the trench has a trench wall facing the tool-receiving hole and a tool-fixing hole recessing from the trench wall, the tool-fixing hole corresponds to the tool-receiving hole.

5. The rekeyable lock cylinder in accordance with claim 1, wherein the guide bar has a tool-receiving portion having a tool-contacting surface facing the first rack components.

6. The rekeyable lock cylinder in accordance with claim 5, wherein the guide bar has a first side, the tool-receiving portion has a groove recessed from the first side of the guide bar.

7. The rekeyable lock cylinder in accordance with claim 6, wherein the tool-receiving portion has a chute recessing from the first side and communicating with the groove.

8. The rekeyable lock cylinder in accordance with claim 6, wherein the tool-contacting surface of the tool-receiving portion is located within the groove.

9. The rekeyable lock cylinder in accordance with claim 1, wherein the guide bar has a plurality of pin runners, the first rack components are engaged with the pin runners respectively.

* * * * *